US008082904B2

(12) United States Patent
Ordanic et al.

(10) Patent No.: US 8,082,904 B2
(45) Date of Patent: Dec. 27, 2011

(54) FUEL PUMP TIMING TO REDUCE NOISE

(75) Inventors: Zlatko Ordanic, Columbus, IN (US); Paul A. Hayes, Columbus, IN (US); Dhanesh M. Purekar, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 12/511,924

(22) Filed: Jul. 29, 2009

(65) Prior Publication Data

US 2010/0186722 A1 Jul. 29, 2010

Related U.S. Application Data

(63) Continuation of application No. PCT/US2008/001258, filed on Jan. 30, 2008.

(60) Provisional application No. 60/898,422, filed on Jan. 30, 2007.

(51) Int. Cl.
*F02M 37/04* (2006.01)

(52) U.S. Cl. ..... 123/495; 123/500; 123/509

(58) Field of Classification Search ..... 123/445, 123/446, 447, 495, 508, 509, 500, 501, 503
See application file for complete search history.

(56) References Cited

U.S. PATENT DOCUMENTS

| | | | | |
|---|---|---|---|---|
| 1,365,301 | A | 1/1921 | Brooks | |
| 3,473,409 | A * | 10/1969 | Reisacher et al. | 74/574.3 |
| 4,345,558 | A * | 8/1982 | Yamaguchi et al. | 123/406.35 |
| 4,408,483 | A | 10/1983 | Bollinger et al. | |
| 4,596,221 | A * | 6/1986 | Ament et al. | 123/501 |
| 4,643,155 | A * | 2/1987 | O'Neill | 123/506 |
| 5,020,978 | A * | 6/1991 | Nashif | 417/363 |
| 5,123,393 | A | 6/1992 | Djordjevic | |
| 5,537,967 | A | 7/1996 | Tashiro et al. | |
| 5,558,066 | A * | 9/1996 | Zhao | 123/495 |
| 5,899,181 | A * | 5/1999 | Kurata et al. | 123/90.17 |
| 6,019,692 | A * | 2/2000 | Kojima et al. | 474/87 |
| 6,142,125 | A * | 11/2000 | Shimayama et al. | 123/501 |
| 6,497,223 | B1 * | 12/2002 | Tuken et al. | 123/497 |
| 6,526,947 | B2 * | 3/2003 | Shimada et al. | 123/495 |
| 6,675,758 | B2 | 1/2004 | Nagata et al. | |
| 6,763,808 | B2 * | 7/2004 | Ryuzaki | 123/446 |
| 6,917,907 | B2 * | 7/2005 | Hsi et al. | 703/8 |
| 7,316,221 | B2 * | 1/2008 | Imamura | 123/505 |

(Continued)

FOREIGN PATENT DOCUMENTS

WO WO 2008/094623 1/2008

OTHER PUBLICATIONS

International Searching Authority. Written Opinion of the International Searching Authority. PCT/US2008/001258. Jun. 10, 2008.

*Primary Examiner* — Thomas N Moulis
(74) *Attorney, Agent, or Firm* — Krieg Devault LLP

(57) ABSTRACT

One embodiment is a fuel system for an internal combustion engine including a fuel pump having a fuel pump gear operable to drive the fuel pump to pressurize fuel. The fuel pump gear is offset relative to engine top dead center by a predetermined angle to reduce a sound or noise. The offset can be determined by selecting the minimum sound produced over a range of offsets or operating conditions.

24 Claims, 4 Drawing Sheets

U.S. PATENT DOCUMENTS

| | | | | |
|---|---|---|---|---|
| 7,376,506 | B2 * | 5/2008 | Schueler | 701/114 |
| 7,540,275 | B2 * | 6/2009 | Otani et al. | 123/508 |
| 7,552,720 | B2 * | 6/2009 | Borg et al. | 123/508 |
| 7,559,313 | B2 * | 7/2009 | Tokuo et al. | 123/501 |
| 2006/0153719 | A1 | 7/2006 | Tanaka et al. | |
| 2008/0098991 | A1 * | 5/2008 | Eddy | 123/504 |
| 2009/0139493 | A1 * | 6/2009 | Shafer et al. | 123/500 |
| 2009/0241908 | A1 * | 10/2009 | Tokuo et al. | 123/476 |
| 2009/0277420 | A1 * | 11/2009 | Otani et al. | 123/447 |

* cited by examiner

FUEL PUMP TIMING TO REDUCE NOISE

CROSS-REFERENCE TO RELATED APPLICATIONS

The present application is a continuation of PCT/US2008/001258, filed Jan. 30, 2008, which claims the benefit of U.S. Provisional Patent Application No. 60/898,422 filed Jan. 30, 2007, each of which is incorporated herein by reference.

TECHNICAL FIELD

The technical field relates to the timing of internal combustion engine fuel pumps.

BACKGROUND

Present approaches to fuel pump timing suffer from a variety of drawbacks, limitations, disadvantages and problems including those respecting pump timing, gear tooth impacts, torsional vibration, gear clatter, noise, vibration, harshness and others. There is a need for the unique and inventive fuel pump timing apparatuses, systems and methods disclosed herein.

SUMMARY

One embodiment is a fuel system for an internal combustion engine including a fuel pump having a fuel pump gear operable to drive the fuel pump to pressurize fuel. The fuel pump gear is offset relative to engine top dead center by a predetermined angle. Further embodiments, forms, objects, features, advantages, aspects, and benefits shall become apparent from the following description and drawings.

DETAILED DESCRIPTION

For purposes of promoting an understanding of the principles of the invention, reference will now be made to the embodiments illustrated in the figures and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would occur to one skilled in the art to which the invention relates.

Figure 1:
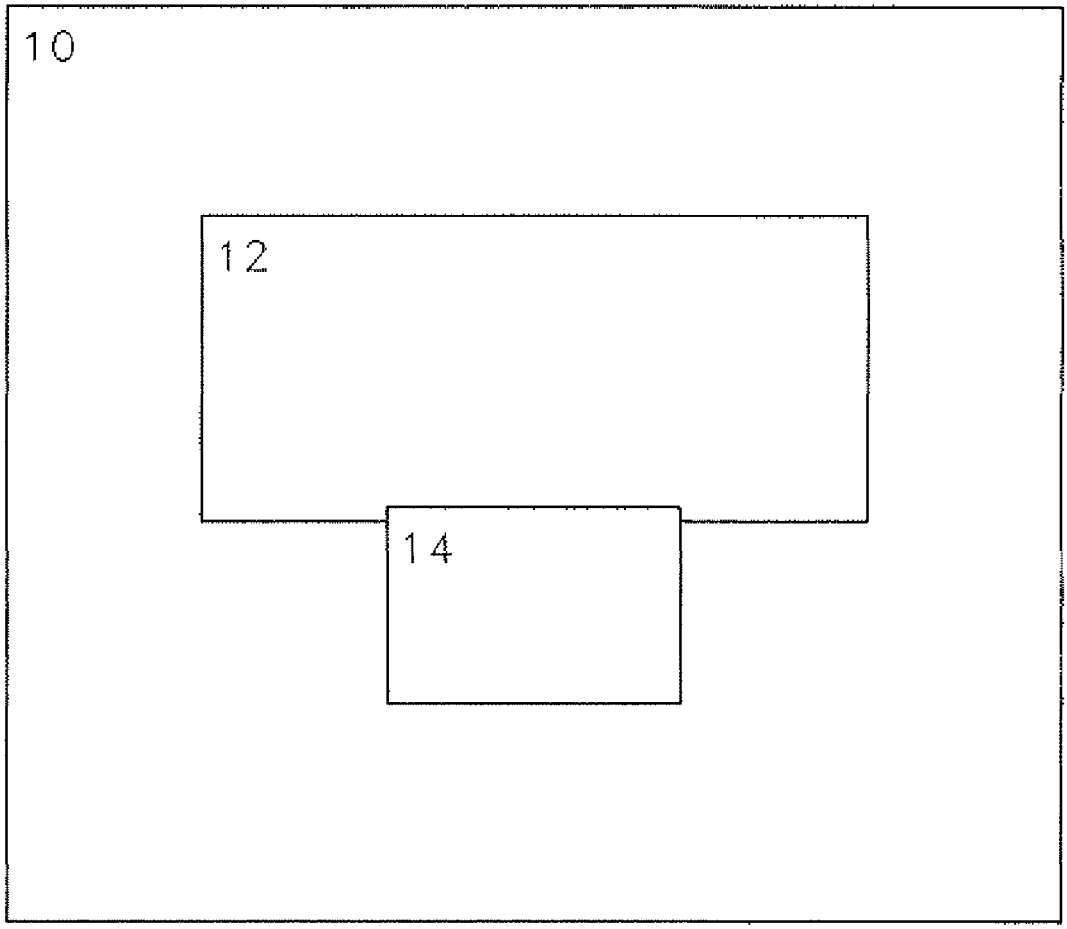
FIG. 1 is a schematic diagram of a vehicle including an internal combustion engine and a fuel system.

With reference to FIG. 1, there is illustrated a vehicle 10 including an internal combustion engine 12 and a fuel system 14 operatively coupled to the engine 12 to provide fuel thereto. Vehicle 10 could be a variety of types of vehicles, for example, a light duty truck, a medium duty truck, a heavy duty truck, a passenger vehicle, a bus, or an industrial or construction vehicle. In one preferred embodiment, internal combustion engine 12 is a turbocharged, in-line six cylinder, front spur gear train driven diesel engine. In another embodiment, internal combustion engine 12 is a V-8 diesel engine. In yet another embodiment, the internal combustion engine 12 is a rotary engine. Additional embodiments contemplate that engine 12 could be a variety of other engines such as, for example, a diesel engine having a different number of cylinders and/or different cylinder configurations which could be turbocharged, supercharged or naturally aspirated. Fuel system 14 is preferably a high pressure common rail fuel system such as, for example, high pressure common rail fuel system 200 which is described below in connection with FIG. 2, but could also be other types of fuel systems which include variations from the common rail fuel system 200.

Figure 2:
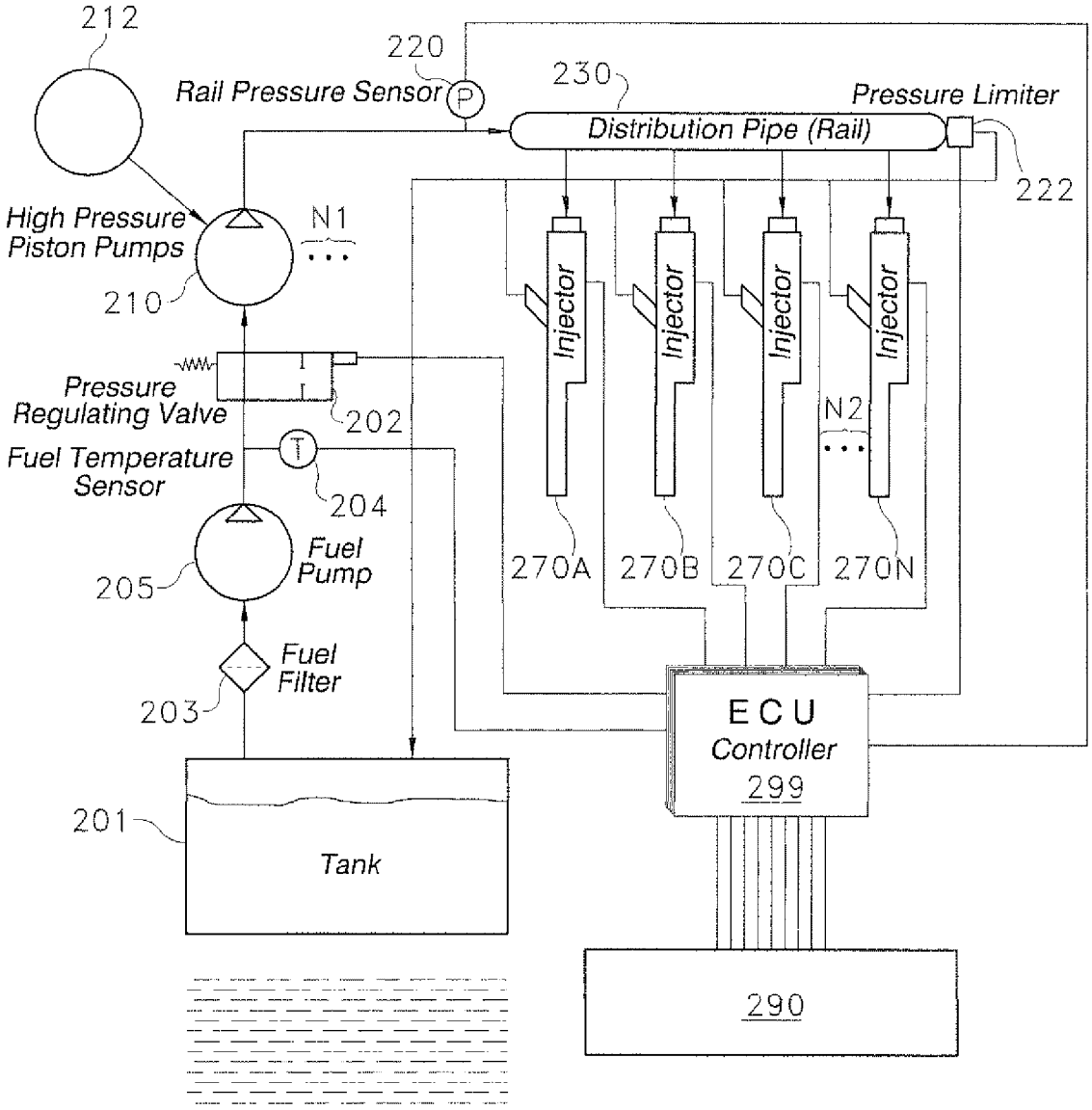
FIG. 2 is a schematic diagram of a high pressure common rail fuel system.

With reference to FIG. 2, there is illustrated a schematic diagram of an exemplary high pressure common rail fuel system 200 that may be used within the vehicle 10 of FIG. 1. Fuel for system 200 is stored in fuel storage tank 201 and may include any varieties of fuel such as aviation and automotive gasolines, and diesel, to set forth just three nonlimiting examples. Low pressure fuel pump 205 pumps fuel stored from fuel storage tank 201 through fuel filter 203 to high pressure fuel pump 210. A pressure regulating valve 202 regulates the provision of fuel from low pressure fuel pump 205 to high pressure fuel pump 210. A fuel temperature sensor 204 senses temperature information of fuel provided from low pressure fuel pump 205 to high pressure fuel pump 210.

High pressure fuel pump 210 includes a number of reciprocating pistons which compress fuel received by high pressure fuel pump 210 and provide pressurized fuel to high pressure common rail 230. As indicated by ellipsis N1, high pressure fuel pump 210 can include multiple pistons which are operable to pressurize fuel. However, other types of high pressure fuel pumps known to those of skill in the art may also be used. One preferred embodiment contemplates that high pressure fuel pump 210 includes three pistons. The pistons of high pressure fuel pump 210 are driven by a drive means 212. In one preferred embodiment, drive means 212 is a fuel pump gear which is driven by a cam gear which, in turn, is driven by the engine crank shaft, an example of which is described hereinbelow with respect to FIG. 3. Other embodiments contemplate a variety of other gear arrangements and other drive structures such as belts, chains, motors, and other devices. High pressure fuel pump 210 is operable to output highly pressurized fuel, for example, fuel pressurized to 1600 bar, 1700 bar, 1800 bar or even greater pressures, although lower pressures are also contemplated.

High pressure common rail 230 receives pressurized fuel from high pressure fuel pump 210 and distributes pressurized fuel to fuel injectors 270A, 270B, 270C, and 270N which are operable to inject pressurized fuel into engine cylinders at commanded times. Some embodiments may include more than one rail wherein a subset of fuel pumps are connected to one rail and another subset of fuel pumps connected to another rail. As indicated by ellipsis N2, a variety of numbers of fuel injectors (and a correlated number of cylinders) is contemplated. A preferred embodiment contemplates six fuel injectors which inject fuel into six in-line cylinders, respectively, though other types of cylinder arrangements are contemplated herein. Rail pressure sensor 220 senses pressure information of the fuel in high pressure common rail 230. Pressure limiter 222 limits the maximum fuel pressure which is permitted in high pressure common rail 230. When the maximum permitted fuel pressure is exceeded, pressure limiter opens and fuel is returned to tank 201 via return line 240.

Engine control unit ("ECU") 299 is operatively coupled to, and receives information from and/or controls pressure limiter 222, rail pressure sensor 220, pressure regulating valve 202, fuel temperature sensor 204, and fuel injectors 270A, 270B, 270C and 270N. ECU 299 is also operatively coupled to and receives information from and/or controls other sensors and engine sensors, systems and components as indicated by block 290.

Figure 3:
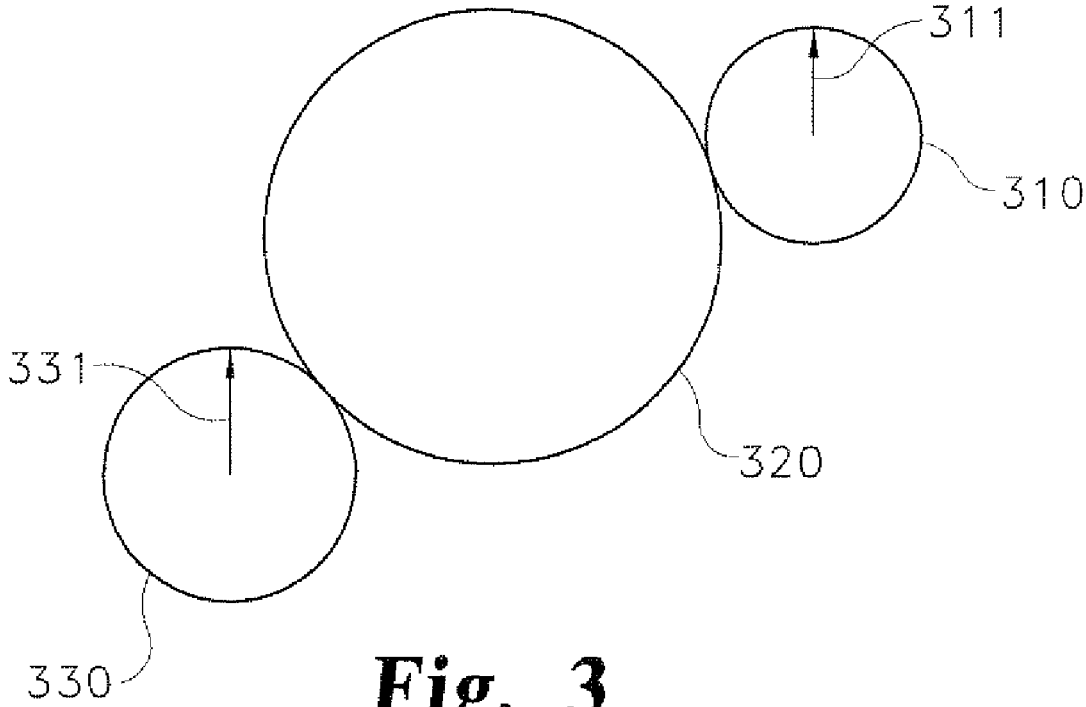
FIG. 3 is a schematic diagram of a gear system for driving a fuel pump.

With reference to FIG. 3, there is illustrated a schematic diagram of a fuel pump gear 310 which is operatively coupled with a cam gear 320 which is in turn operatively coupled with a crank shaft gear 330. During operation of an internal combustion engine (shown in FIG. 1) reciprocating engine pistons coupled to the crank shaft cause crank shaft gear 330 to rotate. Rotation of crank shaft gear 330 drives cam gear 320 which, in turn, drives fuel pump gear 310. The fuel pump gear 310 is geared to rotate at the same rate as the crank shaft gear 330 in the illustrated embodiment, but may be configured to rotate at other rates in alternative embodiments. As discussed above, other gearing arrangements may be provided to drive the fuel pump gear 310. In some embodiments, the crank shaft gear 330 is coupled to a front gear train of a diesel engine, wherein the front gear train may include the cam gear 320 and fuel pump gear 310 of the illustrated embodiment, or may include other gear and/or driven mechanisms.

Rotation of fuel pump gear 310 then drives a shaft which causes the fuel pump pistons (not illustrated) in the high pressure fuel pump 210 to reciprocate and pressurize fuel. The pressurized fuel is then provided to the high pressure common rail 230 shown in FIG. 2, or other pressurized fuel chamber. As illustrated by arrow 331, crank shaft gear 330 is in an engine top dead center position, that is, the position in which one or more reference engine pistons is maximally distant from the crank shaft, or alternatively is a position wherein a volume of a reference working chamber(s) of the engine is at a minimum. As illustrated by arrow 311, fuel pump gear 310 is also in a top dead center position, that is, the position in which one or more reference pistons of the high pressure fuel pump is maximally distant from its drive shaft or, alternatively, is a position wherein a volume of a reference working chamber(s) of the high pressure fuel pump is at a minimum. It will be appreciated that the reference piston or working chamber of either the engine or the fuel pump may be any arbitrary piston or working chamber.

An angular offset, or simply offset, can be defined as the difference between two angles as measured from the crank shaft: (1) the angle of the crank shaft at the fuel pump top dead center; and (2) the angle of the crank shaft at the engine top dead center. As will be appreciated, the offset can be any value within a complete rotation of the crank shaft. In the illustrated embodiment the offset is about zero degrees. The angular offset can be expressed in any unit of measure, including degrees, radians, or arcminutes, to set forth just three nonlimiting examples.

Fuel pump offset values which reduce, minimize, or optimize the sound or noise intensity, pitch, or tone attributable to the high pressure fuel pump can be determined. In the illustrative embodiment discussed hereinbelow, a sound pressure level ("SPL") can be used to determine the offset, though other measures and/or values could also be used. SPL is a calculated value based in part on measured pressures and can sometimes be referred to as an SPL value or SPL measurement. In some embodiments the SPL value can be replaced by other measurements or calculated values such as sound intensity level, to set forth just one nonlimiting example. Other types of measured vibrations or waves, no matter the spectral range, are also contemplated herein. The measured parameters that give rise to the SPL value may be detected and quantified using a microphone, a pressure transducer, accelerometer, or any other suitable sensor. Post processing of the measured parameters may be needed in some situations in preparation for calculating the SPL value or other calculated value useful in determining an appropriate offset value.

In operation, the engine 12 and/or engine 12 and vehicle 10 combination will have a noise profile that may vary within a three dimensional space surrounding the engine 12 and/or engine 12 and vehicle 10. The measured parameters (limited in the illustrated embodiment hereinbelow to sound but may include other measures in other embodiments) may be detected at any arbitrary location within the three dimensional space of the engine 12 standing alone or installed in a vehicle 10. As used herein, the term noise profile includes any measurement of sound, pressure waves, or vibrations as discussed above. The noise characteristic can be expressed by SPL or any variety of other values or measurements and may be a constant value or may be a function of any number of variables, including the location of the measurement, engine operating condition, and angular offset, to set forth just a few nonlimiting examples.

To determine an offset from a range of possible offsets which reduces or minimizes the SPL, various configurations are made between the fuel pump top dead center and the engine top dead center. Initially, both fuel pump gear and crank shaft are positioned in a known position having an initial, known offset. For sake of simplicity, the illustrative embodiment depicts an initial offset of zero degrees. It will be appreciated, however, that other, arbitrary, initial offsets may also be chosen. At least one SPL value is taken at the initial offset, but variations in setup may be provided and further measurements obtained. For example, multiple SPL measurements can be taken at the initial offset over a range of engine conditions from engine idle to engine redline, to set forth just two nonlimiting boundaries of the range. SPL values may also be taken while the engine is subjected to various engine loads, or by changing the ambient air temperature or pressure, or by altering a fuel/air mixture, to set forth just a few additional and/or alternative, but nonlimiting, operating conditions. It may also be desired in some situations to change the physical location that the SPL value is taken in relative to an arbitrary reference point on or near the engine.

After one or more SPL values are taken at the initial offset, the offset is then incremented and the measurements taken at the incremented offset using the same or different operating conditions or setups that were explored in the initial offset. A variety of increment values can be used. For example, in one embodiment the increment value is 12 degrees. In other embodiments, the increment value may be a constant, negative value. In still further embodiments, the increment value may be randomly chosen when moving from one offset to another, or may be a first increment when moving from an initial offset to a second offset, and then a second increment when moving from the second offset to the third offset. Some embodiments may include a constant increment used over a first range, say a 5 degree increment for the first ten offsets examined, and then another increment used over a second range, say 2 degrees over the next twenty offsets. In other embodiments, a constant increment value may be used over a broad range of offsets, with finer and perhaps non-constant increments used over a smaller range to more fully characterize or investigate the SPL values. Increments may even be chosen such as to return to a previously examined offset value.

After measurements are taken at the first incremented offset, the offset may be incremented once more and measurements taken again. This process is preferably repeated to capture samples over an entire range of angular offsets, though less than the full range of possible offset angles could be examined. The SPL values taken at each offset increment can then be plotted to form a chart that depicts the change in SPL as the offset is incremented through a desired range. It will be appreciated that multiple charts can be created depending on the types of experiments conducted. For example, a chart that depicts SPL plotted against offset for a fixed operating condition may be created, or a three dimensional chart that depicts SPL plotted against offset across a range of operating conditions. Some charts may have a fixed value of offset with SPL plotted against a range of operating conditions to examine the noise sensitivity at a fixed offset. Such charts may be supplemented by other charts and additional analysis to determine an appropriate offset to reduce noise and/or other unwanted vibrations.

The data resulting from the incremental offset measuring can be analyzed to determine fuel pump offset values which reduce, minimize or optimize the SPL attributable to the high pressure fuel pump. Many different methods might be used to determine the fuel pump offset. For example, an offset that produces a globally minimum SPL, or one that produces a local minimum, might be used. In addition, an offset located within an identified range of acceptable SPL may be provided if measurement errors or other attributes render a precise determination of the minimum difficult or impossible. In some applications an offset that identified a non-minimum but otherwise adequate SPL might instead be chosen given the demands of the other imposed constraints such as available gear tooth resolutions, fuel economy, or durability, to set forth just a few nonlimiting examples. For example, an offset might be chosen that results in only a partial improvement in SPL but that substantially improves durability. Other data processing and/or evaluation techniques may also be used when analyzing the data to determine a desired offset. For example, an error analysis might be conducted, or a curve may be fit through the data using any variety of techniques such as a regression analysis, to set forth just one nonlimiting example. It will be appreciated that the offset value determined from the analysis may include more than one offset, which may be used to alter the offset value at different operating conditions, if desired.

Figure 4:
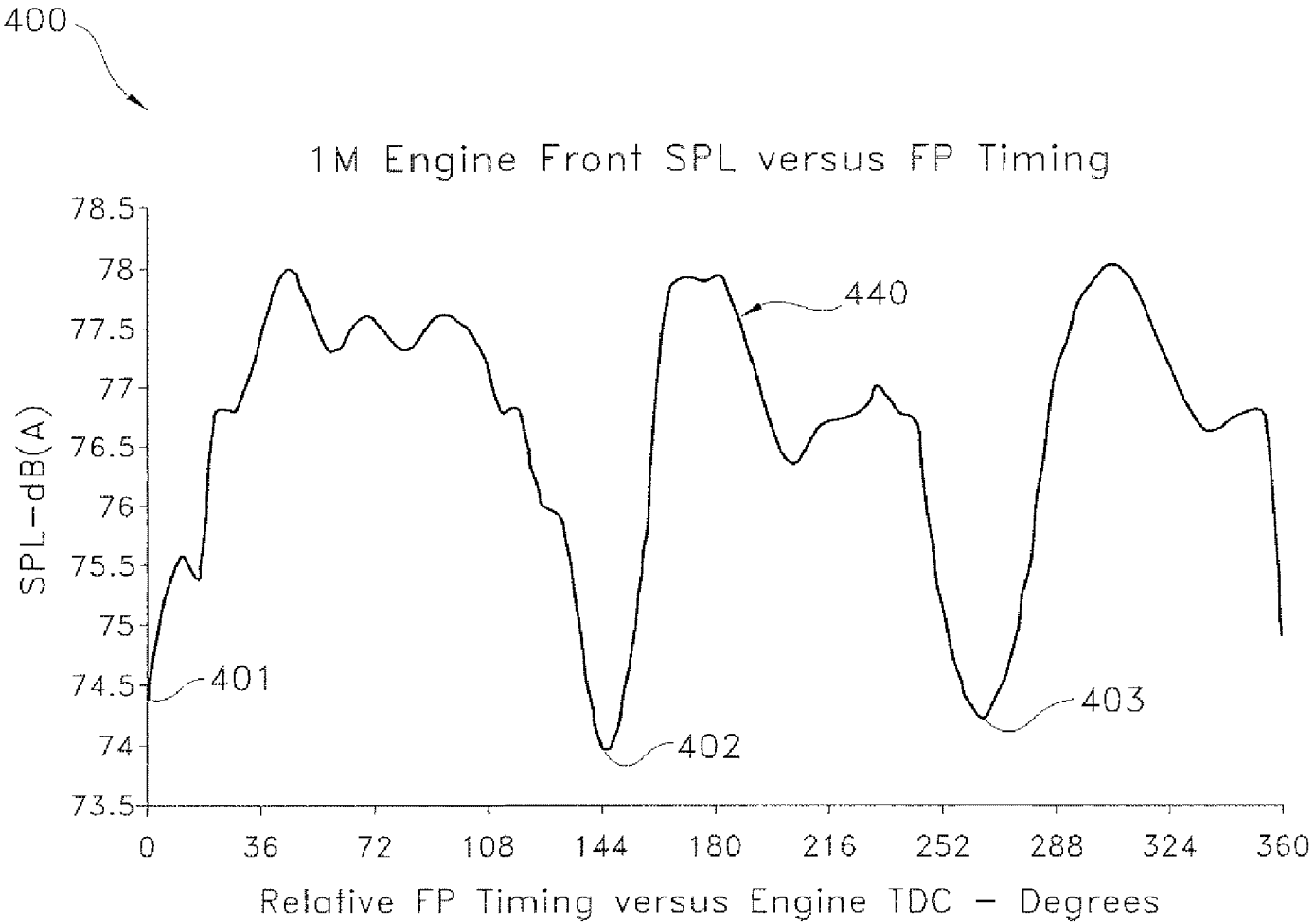
FIG. 4 is a graph of sound pressure level as a function of fuel pump timing.

With reference to FIG. 4, there is illustrated a graph 400 of SPL as a function of fuel pump timing. It will be appreciated that other types of data such as noise or vibration data could have been plotted as a function of pump timing, as was discussed hereinabove. The engine studied, which results are illustrated in graph 400, included an inline six-cylinder engine supplied with fuel by a fuel system having of a fuel pump with three-cylinders. It will be appreciated, therefore, that each revolution of an engine crank shaft resulted in "firing" all three pump cylinders and only three engine cylinders. A front gear train was provided to drive the fuel system. The y-axis of graph 400 is SPL which values are expressed as dB. The x-axis of graph 400 is the angular offset between fuel pump top dead center and engine top dead center in units of degrees. To generate graph 400, an incremental offset measurement technique, such as was described above, was performed on an in-line six cylinder diesel engine with an offset increment of roughly twelve degrees, with the exception of offset increments that were used near 120 degrees, 240 degrees, and 360 degrees of offset. In these three instances, the offset increment used was six degrees. As a result, this technique produced 36 data points which were plotted on graph 400. Curve 440 was given by these data points. This curve revealed SPL minima 401, 402, and 403. As shown in graph 400, SPL minima 401, 402, and 403 appear to be at about zero degrees offset, about 144 degrees offset, and about 260 degrees offset, respectively. An error analysis was performed on the data illustrated in graph 400 which revealed that the error-corrected minima were at about 0 degrees +/−6 degrees, about 120 degrees +/−6 degrees, and about 240 degrees +/31 6 degrees. Based on this information, the offset between the fuel pump gear top dead center and the engine top dead center was set to a predetermined value which optimized SPL. This optimized offset reduced gear clatter at engine idle conditions, across the whole engine speed range, and at all partial load conditions. As it happens, the torque pulses coming out of the fuel pump with its three cylinders "firing" and the engine cylinders with its three cylinders "firing" per crank shaft revolution may be matched, with the result that gear tooth impacts created by the torsional vibration of the front gear train are significantly reduced. Other engines having other fuel pumps may not have the same result. For example, other embodiments having a mismatched number of fuel pump pistons and engine cylinders may have different offsets than those depicted in FIG. 4, and furthermore may have a different result with regard to matching torque pulses. It should be understood that while these results are preferred they need not be present in every embodiment.

While exemplary embodiments of the invention have been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a driving mechanism;

an internal combustion engine including an engine piston disposed within an engine working chamber and operatively coupled to the driving mechanism; and a fuel pump including a pump piston disposed within a fuel pump working chamber and operatively coupled to the driving mechanism;

wherein the engine piston and the fuel pump piston are operatively coupled to the driving mechanism such that a noise profile of the internal combustion engine is below a threshold level when a relationship exists between a configuration of the driving mechanism when the engine piston is at a top dead center position within the engine working chamber and a configuration of the driving mechanism when the fuel pump piston is at a top dead center position within the fuel pump working chamber.

2. An apparatus according to claim 1 wherein the noise profile is a sound pressure level.

3. An apparatus according to claim 2 wherein the engine piston and the fuel pump piston are operatively coupled to the driving mechanism such that the noise profile of the internal combustion engine is at a minimum sound pressure level.

4. An apparatus according to claim 1 wherein the driving mechanism includes:

a cam gear;

a crank shaft gear operatively coupled to the engine piston and to the cam gear; and a fuel pump gear operatively coupled to the crank shaft gear.

5. An apparatus according to claim 4 wherein the relationship exists when a difference between an angle of the cam gear when the engine piston is at the top dead center position within the engine working chamber and an angle of the cam gear when the fuel pump piston is at the top dead center position within the fuel pump working chamber is about 0 degrees.

6. An apparatus according to claim 1 wherein the fuel pump working chamber is disposed within a common rail fuel system.

7. An apparatus, comprising:

an internal combustion engine including an engine working chamber having a top dead center and a fuel pump working chamber having a top dead center, the internal combustion engine also including a noise profile that incorporates measurements made at a variety of different angular biases between the engine working chamber top dead center and the fuel pump working chamber top dead center; and a crank shaft angular bias between the engine working chamber top dead center and the fuel pump working chamber top dead center, the crank shaft angular bias is based upon the noise profile, wherein the internal combustion engine is a turbocharged, in-line six cylinder engine.

8. A method comprising:

positioning a fuel pump gear of a fuel pump to have an angular relationship with a crank shaft;

operating an engine system including the fuel pump and the crank shaft;

measuring a noise produced by the engine system; and changing the angular relationship of the fuel pump gear and the crank shaft based on the measuring.

9. A method according to claim 8 wherein the measuring includes measuring a pressure wave.

10. A method according to claim 8 wherein the measuring includes measuring a vibration.

11. A method according to claim 10 wherein the measuring includes measuring a sound.

12. A method according to claim 8 which further includes repeating the measuring and the changing.

13. A method according to claim 12 further comprising measuring and the changing over a plurality of angular relationships spanning a substantially 360 degree range.

14. A method according to claim 12 wherein the changing includes increasing the angular relationship by 12 degrees.

15. A method according to claim 12 which further includes utilizing data of the measuring and the again measuring to determine the angular relationship.

16. A method according to claim 12 which further includes identifying at least one noise minimum based upon data of the repeated measuring.

17. A method comprising:

operating an internal combustion engine having a piston;

operating a fuel pump coupled to the internal combustion engine;

evaluating a sound indication of the internal combustion engine; and setting a fuel pump timing relative to a top dead center of the internal combustion engine based upon the evaluating.

18. A method according to claim 17 wherein the setting includes selecting a timing based upon a minimum sound indication.

19. A method according to claim 17 wherein the evaluating includes changing a fuel pump timing over a range of timing values.

20. A method according to claim 17 wherein the evaluating includes plotting a measurement of sound over a range of fuel pump timing values.

21. A method according to claim 17 wherein the evaluating includes plotting a measurement of sound over a range of engine operating conditions.

22. A method according to claim 17 wherein the evaluating includes selecting a desired sound indication.

23. An apparatus according to claim 4 wherein the relationship exists when a difference between an angle of the cam gear when the engine piston is at the top dead center position within the engine working chamber and an angle of the cam gear when the fuel pump piston is at the top dead center position within the fuel pump working chamber is about 120 degrees.

24. An apparatus according to claim 4 wherein the relationship exists when a difference between an angle of the cam gear when the engine piston is at the top dead center position within the engine working chamber and an angle of the cam gear when the fuel pump piston is at the top dead center position within the fuel pump working chamber is about 240 degrees.

* * * * *